United States Patent [19]

Isobe

[11] Patent Number: 4,930,417

[45] Date of Patent: Jun. 5, 1990

[54] PRINTER FOR SIMULTANEOUSLY FORMING PLANOGRAPHIC PRINTING SURFACES AND PRINTING INK IMAGES

[75] Inventor: Minoru Isobe, Tokyo, Japan

[73] Assignee: Oki ELectric Industry Co., Ltd., Tokyo, Japan

[21] Appl. No.: 294,770

[22] Filed: Jan. 6, 1989

[30] Foreign Application Priority Data

Jan. 29, 1988 [JP] Japan ..... 63-16887

[51] Int. Cl.[5] ..... B41C 1/10; B41N 1/12; B41M 1/08

[52] U.S. Cl. ..... 101/465; 101/450.1; 101/467; 101/453; 400/120

[58] Field of Search ..... 101/463.1, 465, 466, 101/467, 450.1, 453, 454, 458, 459; 400/120

[56] References Cited

U.S. PATENT DOCUMENTS

| | | | |
|---|---|---|---|
| 3,422,759 | 1/1969 | Brynko et al. | 101/450.1 X |
| 3,678,852 | 7/1972 | Feinleib et al. | 101/450.1 X |
| 3,745,235 | 7/1973 | Bestenreiner et al. | 101/467 X |
| 3,859,920 | 1/1975 | Ritzerfeld | 101/467 |
| 4,660,051 | 4/1987 | Sasaki | 400/120 X |
| 4,725,154 | 2/1988 | Babsch | 400/120 |
| 4,844,770 | 7/1989 | Shiraishi et al. | 400/120 X |

FOREIGN PATENT DOCUMENTS

| | | | |
|---|---|---|---|
| 39457 | 3/1983 | Japan | 101/467 |
| 70572 | 4/1984 | Japan | 101/467 |
| 264953 | 11/1987 | Japan | 101/467 |
| 267194 | 11/1987 | Japan | 101/463.1 |

OTHER PUBLICATIONS

Camis et al., "Liquid Ink Induction Imaging System", Xerox Disclosure Journal, pp. 27–28, vol. 2, No. 2, Mar./Apr. 1977.

*Primary Examiner*—Clifford D. Crowder

*Attorney, Agent, or Firm*—Flynn, Thiel, Boutell & Tanis

[57] ABSTRACT

A printer capable of simultaneously forming planographic printing surface and printing ink images. The printer comprises a control unit, a plate feeding unit for continuously feeding a printing plate formed by coating an oil-repellent sheet with a fusible lipophilic thermal film, a plate making unit having a thermal head for locally and selectively heating lipophilic thermal film according to electric signals to remove portions of the lipophilic thermal film to make a planographic printing surface having a printing area, an inking unit having an inking roller for applying a liquid ink to the planographic printing surface of the printing plate, a transfer unit comprising a platen roller for continuously feeding a recording medium, and a pressure roller for pressing the planographic printing surface of the printing plate against the recording medium to transfer the inked pattern of the printing area to the recording medium. The control unit controls the plate feeding unit, the plate making unit, the linking unit and the transfer unit for synchronous operation so that the planographic printing surface is formed continuously while the inked pattern of the printing area of the printing plate is transferred continuously to the recording medium.

9 Claims, 2 Drawing Sheets

PRINTER FOR SIMULTANEOUSLY FORMING PLANOGRAPHIC PRINTING SURFACES AND PRINTING INK IMAGES

BACKGROUND OF THE INVENTION

1. Field of the invention:

The present invention relates to a printer which forms a printing surface by heating a base sheet coated with a lipophilic thermal film, applies a liquid ink to the printing surface, and presses a recording medium against the printing surface to transfer an inked image to the recording medium and, more particularly, to a printer capable of simply and continuously making a dry planographic printing plate in a short time by means of electric signals without requiring any lineal drawing, and capable of continuously performing a printing operation through a step of applying a liquid ink to the planographic printing plate to form an inked image and a step of pressing a recording medium against the planographic printing plate to transfer the inked image to a recording medium.

2. Description of the Related Art:

Printers used as the output equipments of information processing systems are classified roughly into impact printers and nonimpact printers. Recently, demand for nonimpact printers, which are capable of operating silently, printing pictures and graphs and high extendability, has increased greatly. Typical nonimpact printers are electrophotographic printers using toner as a visible image forming medium, ink-jet printers which jet ink particles electrostatically and thermal printers which use a fusible or sublimable thermal transfer ribbon.

The accessibility of the printer is dependent on facility in handling consumable articles, such as toner, ink, ribbons and recording sheets. That is, toner which is liable to scatter, ink which is liable to spill, the transfer ribbon having difficulty in printing in natural color, thermal print papers having difficulty in multicolor printing, and recording sheets having trouble with electrostatic charging, blotting and smoothness are principal factors adversely affecting the accessibility of the printer. Accordingly, those consumable articles also are required to meet specific quality conditions. Furthermore, in addition to accessibility, capability of printing in natural color in satisfactory print quality and capability of printing on ordinary paper sheets are principal demands on the printer. Particularly, the printer is required to be able to print in a print quality equal to that of prints printed with a traditional printing plate. Thermal printers are evaluated favorably in respect of accessibility.

However, the preparation of a conventional printing plate requires many steps of processing a plate, such as a zinc plate, aluminum plate or a plastic plate, including drawing, transferring, engraving, cutting, forming a photosensitive film over the plate, optical exposure, developing, etching and/or rubber application. The photographic plate making process, in particular, includes chemical processes, such as washing and etching. Accordingly, it has been difficult to construct a single compact printer capable of carrying out the photographic plate making process and the printing process.

SUMMARY OF THE INVENTION

The present invention has been made in view of the foregoing problems in the conventional printers.

Accordingly, it is an object of the present invention to provide a printer capable of simply and continuously making planographic printing medium without requiring complicated traditional plate making processes, such as a washing process and etching process, continuously performing a printing operation simultaneously with the plate making operation.

To achieve the object of the invention, the present invention provides a printer capable of performing a series of processes from a planographic printing plate making process to a printing process, comprising a plate feeding unit which feeds a continuous thermal plate formed by coating an oil-repellent base sheet, such as an oil-repellent silicon resin sheet, with a fusible or sublimable lipophilic thermal film, a planographic printing plate making unit having a thermal head which heats the thermal plate locally and selectively, according to electric signals to make a dry planographic printing plate carrying a printing area, an ink applying unit which applies ink to the printing area of the planographic printing plate, and a transfer unit which transfers the inked image of the printing area to a recording medium.

According to the present invention, the lipophilic thermal film coating the oil-repellent base sheet is fused or sublimed locally and selectively by the thermal head to form a planographic printing surface having a printing area including a pattern or characters of the lipophilic thermal film and exposed portions of the oil-repellent sheet, ink is applied to the printing area, and then, the image of the inked printing area is transferred clearly to a recording medium.

The above and other objects, features and advantages of the present invention will become more apparent from the following description taken in conjunction with the accompanying drawings.

DESCRIPTION OF THE PREFERRED EMBODIMENT

Figure 1:
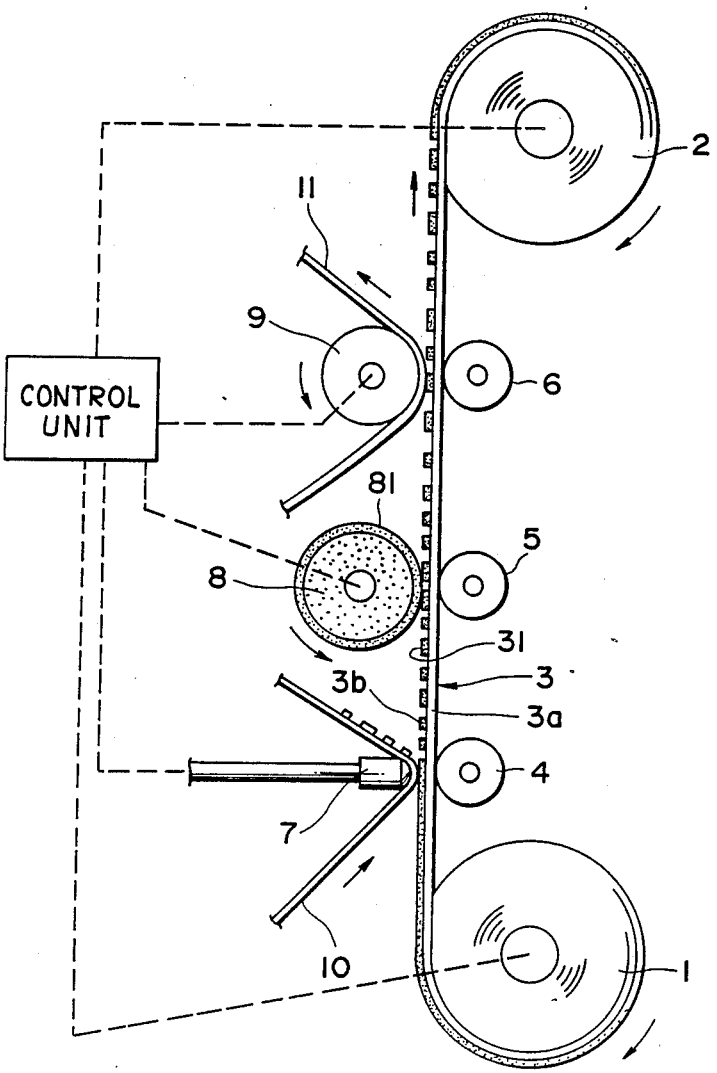
FIG. 1 is a schematic side elevation showing an essential portion of a printer embodying the present invention.

Referring to FIG. 1, a printer has a plate supply roller 1 mounted with a roll of a continuous printing plate 3. The printing plate 3 is extended through a planographic printing surface making unit, an inking unit and a transfer unit to a winding roller 2 for winding the printing plate 3. The planographic printing surface making unit includes a thermal head 7 and a backup roller 4 disposed opposite to the thermal head 7 to press the printing plate 3 against the thermal head 7. The inking unit includes an inking roller 8 and a pressure roller 5 disposed opposite to the inking roller 8 to press the printing plate 3 against the inking roller 8. The transfer unit includes a platen roller 9 and a pressure roller 6 disposed opposite to the platen roller 9 to press a recording sheet 11 against the printing plate 3.

A very thin continuous absorptive sheet 10 is extended so as to be pressed against the printing plate 3 by the thermal head 7. The circumference 81 of the inking roller 8 is pressed against the planographic printing surface 31 of the printing plate 3 to apply a liquid ink to the planographic printing surface 31. The recording sheet 11 is pressed against the inked planographic printing surface 31 of the printing plate 3 by the platen roller 9 to transfer a pattern of the liquid ink from the planographic printing surface 31 to the recording sheet 11.

Figure 2:
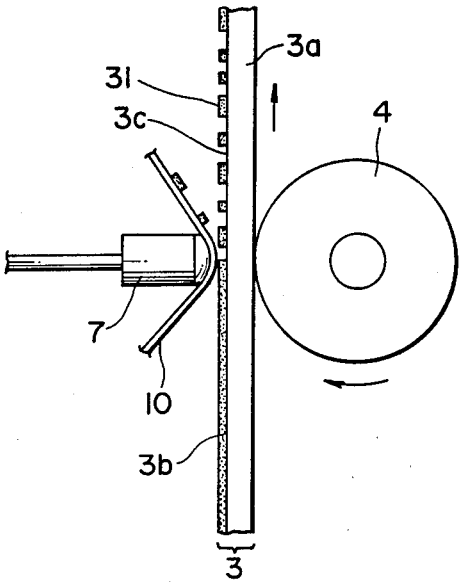
FIG. 2 is a schematic side elevation of assistance in explaining a manner of making a planographic printing plate.

Referring to FIG. 2, the printing plate 3 is formed by coating a base sheet 3*a*, such as an oil-repellent silicon resin sheet or a sheet coated with a oil-repellent silicon resin film, with a hard, smooth, dry lipophilic thermal film 3*b* of a thickness in the range of 2 to 3 mm. The lipophilic thermal film is a fusible film or a heat-sublimable film. In forming the planographic printing surface 31, the thermal head 7 is pressed on the effective surface of the printing plate 3, namely, the surface coated with the lipophilic thermal film, and then a control unit, applies electric signals to the thermal head 7 to heat the lipophilic thermal film locally and selectively according to the electric signals so that oil-repellent portions 3*c* are formed in the lipophilic film 3*b*. Thus, the planographic printing surface 31 is formed on the printing plate 3. The portions of the lipophilic thermal film fused or sublimed by the selective heating operation of the thermal head 7 are absorbed by the absorptive sheet 10 extended in between the thermal head 7 and the effective surface of the printing plate 3.

Figure 3:
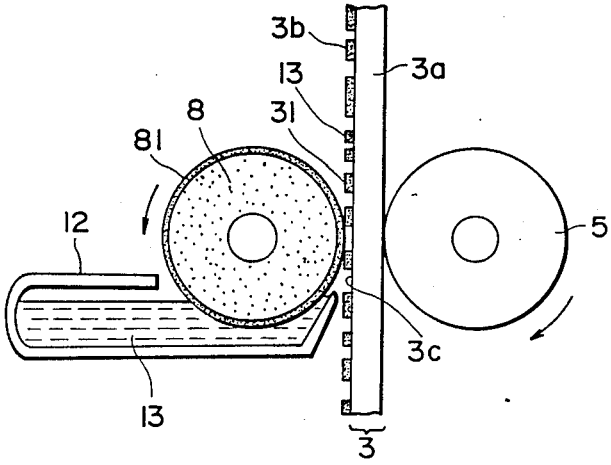
FIG. 3 is a schematic side elevation of assistance in explaining a manner of applying a liquid ink to a planographic printing surface.

FIG. 3 shows an inking unit having an ink tank 12 containing a liquid ink 13 to be applied to the planographic printing surface 31. A planographic printing surface 31 having a pattern of the lipophilic thermal film 3*b* and the oil-repellent portions 3*c* formed by locally and selectively removing the lipophilic thermal film 3*b* by heating the lipophilic thermal film 3*b* by the thermal head 7 to expose portions of the oil-repellent base sheet 3*a* is formed on the printing plate 3. The inked circumference 81 of the inking roller 8 partially dipped in the liquid ink 13 contained in the ink tank 12 is pressed against the planographic printing surface 31 of the printing plate. 3 to apply the liquid ink 13 to the pattern of the lipophilic thermal film 3*b*, and then the inked pattern of the lipophilic thermal film 3*b* is transferred to the recording sheet 11.

Ordinarily, the circumference 81 of the inking roller 8 is provided with pits of a predetermined diameter and a predetermined depth, matt-finished or coated with felt so that the inking roller 8 is able to pick up the liquid ink 13 and to retain a predetermined quantity of the liquid ink 13.

The dry planographic printing plate making operation and printing operation of the printer will be described hereinafter.

As shown in FIG. 1, the printing plate 3 extended between the plate supply roller 1 and the winding roller 2 is unwound from the plate supply roller 1 by feed rollers, not shown, and is wound on the winding roller 2. The feed of the absorptive sheet 10, the rotation of the inking roller and the rotation of the platen roller 9 for feeding the recording sheet 11 are controlled by the control unit in synchronism with the feed of the printing plate 3. While the printing plate 3 is being fed in such a manner, the thermal head 7 is pressed against the printing plate 3 to heat the lipophilic thermal film 3*b* locally and selectively. The thermal head 7 is of a known type widely employed in thermal printers and facsimile equipments, having a plurality of heating elements arranged in a matrix and heated selectively according to electric signals. The application of the electric signals to the heating elements of the thermal head 7 also is controlled in synchronism with the feed of the printing plate 3. The thermal head 7 is thus controlled to fuse or sublimate the lipophilic thermal film 3*b* locally and selectively. Then, the fused or sublimated lipophilic thermal material is absorbed by the absorptive sheet 10 extended in between the thermal head 7 and the lipophilic thermal film 3*b*, and hence the fused or sublimed lipophilic thermal material is not scattered. Thus, the thermal head 7 fuses or sublimates the lipophilic thermal film 3*b* locally and selectively according to electric signals applied thereto by the control unit to expose desired oil-repellent portions 3*c* so that the planographic printing surface 31 is formed. Then, the liquid ink 13 is applied to the planographic surface 31 by the inking roller 8. The liquid ink 13 adheres to the planographic printing surface 31 excluding the exposed oil-repellent portions 3*c*. Then, the recording sheet 11 is pressed against the inked planographic printing surface 31 by the platen roller 9 to transfer the liquid ink applied to the planographic printing surface 31 excluding the exposed oil-repellent portions 3*c* to the recording sheet 11. Thus, desired characters and patterns are printed on the recording sheet 11.

The backup roller 4 and the pressure rollers 5 and 6 can be separated respectively from the thermal head 7, the inking roller 8 and the platen roller 9 to facilitate changing the absorptive sheet 10, cleaning the thermal head 7 and changing and cleaning the inking roller 8.

As is apparent from the foregoing description, the printer in accordance with the present invention is capable of printing characters and patterns in a satisfactory print quality on ordinary recording media and does not need any special recording medium and is capable of economically producing a comparatively small number of copies. Since the printing surface can easily and continuously be formed, each document can be printed in a reduced time. Furthermore, the printer incorporating the unit for forming the dry planographic printing plate can be formed in a compact construction.

Although the invention has been described in its preferred form with a certain degree of particularity, obviously many changes and variations are possible therein. It is therefore to be understood that the present invention may be practiced otherwise than specifically described herein.

What is claimed is:

1. A printer capable of simultaneously forming a planographic printing surface and printing ink images, comprising:

a control unit;

a printing plate formed by an oil-repellent sheet coated with a fusible or heat-sublimable lipophilic thermal film layer, said lipophilic thermal film layer defining an effective surface of said printing plate;

a plate feeding unit for continuously feeding said printing plate;

a plate making unit comprising a thermal head connected to said control unit for locally and selectively heating the lipophilic thermal film layer according to electric signals applied thereto by the control unit, and a backup roller for pressing the printing plate, as fed by said plate feeding unit, against the thermal head to locally and selectively remove portions of the lipophilic thermal film layer and expose areas of the oil-repellent sheet to make a planographic printing surface having a printing area;

an inking unit comprising an ink tank containing a liquid ink, an inking roller partially dipped in the liquid ink contained in the ink tank, and a pressure roller for pressing the printing plate, as fed by said plate feeding unit, against the circumference of the inking roller to ink the printing area of the planographic printing surface; and a transfer unit comprising a platen roller for continuously feeding a recording medium, and a pressure roller for pressing the planographic printing surface of the printing plate, as fed by said plate feeding unit, against the recording medium being fed by the platen roller to transfer the inked pattern of the printing area to the recording medium.

2. A printer according to claim 1, wherein the thermal head heats locally and selectively the effective surface of the printing plate from the side of the printing plate on which the lipophilic thermal film is located.

3. A printer according to claim 1, wherein an absorptive sheet capable of absorbing the fused or sublimed lipophilic thermal is interposed in between the effective surface of the printing plate and the thermal head.

4. A printer according to claim 1, wherein the printing plate is a long sheet wound in a roll on a plate supply roller of the plate feed unit and extended through the plate making unit, the inking unit and the transfer unit so as to be taken up on a winding roller of the plate feed unit, and wherein the control unit controls the plate feeding unit, the plate making unit, the inking unit and the transfer unit for synchronous operation.

5. A printer for imaging a printing plate and printing ink images, comprising:

a movably supported printing plate having a laminate structure, said printing plate including an oil-repellent layer and a heat sensitive lipophilic layer, said lipophilic layer being provided as a coating on said oil repellent layer;

heating means for locally and selectively heating and removing from said printing plate predetermined portions of said heat sensitive lipophilic layer and simultaneously exposing predetermined portions of said oil-repellent layer which were previously coated by said predetermined portions of said lipophilic layer, said heating means including an electrically controlled thermal head adapted to be pressed against said printing plate on a side thereof opposite said oil-repellent layer;

means for continuously moving said printing plate past said thermal head;

inking means for applying ink to an area of said printing plate containing said exposed portions of said oil-repellent layer; and transfer means for transferring the ink from said area of said printing plate to a recording medium.

6. The apparatus according to claim 5, wherein said heating means further includes an absorptive sheet interposed between and in direct contact with said thermal head and said printing plate, said absorptive sheet being adapted to absorb said predetermined portions of said heat sensitive lipophilic layer they are heated, said absorptive sheet directly contacting lipophilic layer but only over a limited contact area over which a thermal head contacts said absorptive sheet.

7. The apparatus according to claim 6, wherein said sensitive lipophilic layer is made from a dry lipophilic film which is heat fusible and has a thickness in a range approximately 2–3 mm, and wherein said oil-repellent layer made from an oil-repellent silicon resin.

8. The apparatus according to claim 7, wherein said repellent layer includes one of a silicon resin sheet and coated with a silicon resin film.

9. The apparatus according to claim 6, wherein said sensitive lipophilic layer is made from a dry lipophilic film which is heat-sublimable and has a thickness in a range approximately 2–3 mm.

* * * * *

UNITED STATES PATENT AND TRADEMARK OFFICE

CERTIFICATE OF CORRECTION

PATENT NO. : 4,930,417

DATED : June 5, 1990

INVENTOR(S) : Minoru ISOBE

It is certified that error appears in the above-identified patent and that said Letters Patent is hereby corrected as shown below:

Column 6, line 29; after "said" insert ---heat---.

Column 6, line 35; change "repellent" to ---oil-repellent---.

Column 6, line 37; after "said" insert ---heat---.

Signed and Sealed this

Thirty-first Day of December, 1991

*Attest:*

HARRY F. MANBECK, JR.

*Attesting Officer*

*Commissioner of Patents and Trademarks*